United States Patent [19]

Ackerman et al.

[11] Patent Number: 4,603,989

[45] **Date of Patent: * Aug. 5, 1986**

[54] COSMETIC CONTAINER CONSTRUCTION

[75] Inventors: Walter T. Ackerman, Watertown; Edward F. Klimeck, Waterbury, both of Conn.

[73] Assignee: Risdon Corporation, Naugatuck, Conn.

[ * ] Notice: The portion of the term of this patent subsequent to Apr. 30, 2002 has been disclaimed.

[21] Appl. No.: 702,620

[22] Filed: Feb. 19, 1985

Related U.S. Application Data

[63] Continuation-in-part of Ser. No. 538,908, Oct. 4, 1983, Pat. No. 4,514,102.

[51] Int. Cl.[4] ..... B43K 21/08; B43K 23/00

[52] U.S. Cl. ..... 401/78; 401/74; 401/75; 401/79; 401/98

[58] Field of Search ..... 401/78, 74, 77, 79, 401/75, 98

[56] References Cited

U.S. PATENT DOCUMENTS

| | | | |
|---|---|---|---|
| 2,273,138 | 2/1942 | Peterson | 401/78 |
| 2,333,889 | 11/1943 | Ruekberg | 401/78 |
| 2,337,682 | 12/1943 | Reichenbach | 401/78 |
| 2,351,395 | 6/1944 | Broder | 401/78 |
| 2,442,109 | 5/1948 | Anderson | 401/74 |
| 2,469,631 | 5/1949 | Broder | 401/78 |
| 2,780,351 | 2/1957 | Grisel | 401/78 |
| 2,797,803 | 7/1957 | Hopgood | 401/78 |
| 2,814,384 | 11/1957 | Dulberg | 401/78 |
| 3,083,822 | 4/1963 | Clark | 401/78 |
| 3,083,823 | 4/1963 | Metreaud | 401/78 |
| 3,124,244 | 3/1964 | Hopgood | 401/78 |
| 3,124,245 | 3/1964 | Hopgood | 401/78 |
| 3,175,680 | 3/1965 | Fuglsang-Madsen et al. | 401/78 |
| 3,230,960 | 1/1966 | Moore et al. | 401/78 |
| 3,272,327 | 9/1966 | Busch | 401/78 |
| 3,298,509 | 1/1967 | Hultgren | 401/78 |
| 3,310,168 | 3/1967 | Landen | 401/78 |
| 3,393,036 | 7/1968 | Fuglsang-Madsen | 401/78 |
| 3,438,714 | 4/1969 | Seaver | 401/78 |
| 3,677,654 | 7/1972 | Davis | 401/78 |
| 3,850,183 | 11/1974 | Gruska | 401/78 |
| 4,417,827 | 11/1983 | Kasai et al. | 401/78 |
| 4,514,102 | 4/1985 | Ackerman et al. | 401/75 |

FOREIGN PATENT DOCUMENTS

| | | | |
|---|---|---|---|
| 3319031 | 11/1984 | Fed. Rep. of Germany | 401/75 |
| 2143212 | 7/1984 | United Kingdom | 401/78 |

*Primary Examiner*—Richard J. Apley
*Assistant Examiner*—Alfedo Acoff
*Attorney, Agent, or Firm*—Hopgood, Calimafde, Kalil, Blaustein & Judlowe

[57] ABSTRACT

The invention contemplates a cosmetic-container of the propel-repel variety wherein all parts are assembled and retained by interference fit and wherein metal-to-plastic interfaces characterize essentially all sliding engagements. The arrangement is such as to provide a luxury "feel" through controlled drag torque (resistance) to relative rotation of the parts. And provision is made to positively retain any retracted position of the pomade carrier, whatever the remaining useful extent of involved pomade.

18 Claims, 7 Drawing Figures

COSMETIC CONTAINER CONSTRUCTION

RELATED CASE

This application is a continuation-in-part of our copending application, Ser. No. 538,908, filed Oct. 4, 1983, now U.S. Pat. No. 4,514,102.

BACKGROUND OF THE INVENTION

The invention relates to lipstick or the like containers of the so-called propel/repel variety wherein pomade substance mounted to a central carrier member is selectively displaced within the inner of two relatively rotatable tubular members, there being cam-follower means on the carrier member in continuous engagement with cam formations in the tubular members, for imparting such displacement.

In one period in the development of the art, such containers were all-metal. Clearances had to be observed and lubrication applied, to achieve smooth action. And with the more recent adoption of injection-molded plastic technology, the need for metal parts has all but disappeared. However, even with precisely formed plastic parts, the design technology has been somewhat influenced by the all-metal technology, to the extent that clearances must still be provided. Yet, regardless of the involved one or the other of these technologies, there has been a perceived need to provide clearances of such magnitude as to entail a degree of axial play in the retention of the tubular members to each other. Such play becomes aggravated as coacting plastic parts may shrink, and for this or other reasons there has been a lack of "silkiness" or quality "feel" in the operational handling of such containers.

BRIEF STATEMENT OF THE INVENTION

It is an object of the invention to provide an improved lipstick-container construction, wherein properties of plastic parts and of metal parts are optimized for superior action in the final product.

A specific object is to provide such a construction wherein axial play is at a minimum.

Another specific object is to provide a construction meeting the above objects and inherently characterized by predetermined, controlled, smooth and uniform torsional friction or drag, in the course of rotary actuation.

Another specific object is to provide a new basic internal arrangement of components to achieve the above objects, while also lending itself to adoption and use of a variety of external or finish design appearances, as may be variously desired to accommodate the different style requirements of different cosmetic-house customers.

The invention achieves the foregoing objects in an arrangement of parts wherein the outer tubular member includes a molded-plastic sleeve with a radially outward circular flange at its lower end, and wherein the inner tubular member comprises three parts in circumferentially engaged force-fitted relation; the inner and outer parts are of metal and the third part is an intermediate plastic skirt which is squeezed into permanent circumferential engagement with both of the inner and outer metal parts by reason of the force-fitted relation. The arrangement is such that the upper axial end of the skirt establishes a first shoulder, and a radially inward flange on the outer metal part establishes a second shoulder; and said shoulders have a predetermined fit to the respective upper and lower surfaces of the sleeve flange.

Thus, circumferentially continuous metal-to-plastic engagement characterizes the positioning fit to at least one of the surfaces of the sleeve flange. In general, the fitted parts requiring relative motion intentionally involve metal-to-plastic engagement, and the fitted parts requiring no relative motion are force-fitted, with primary force reaction between or dependent upon metal parts.

DETAILED DESCRIPTION

A preferred embodiment of the invention will be described in detail, in conjunction with the accompanying drawings, in which.

Figure 1:
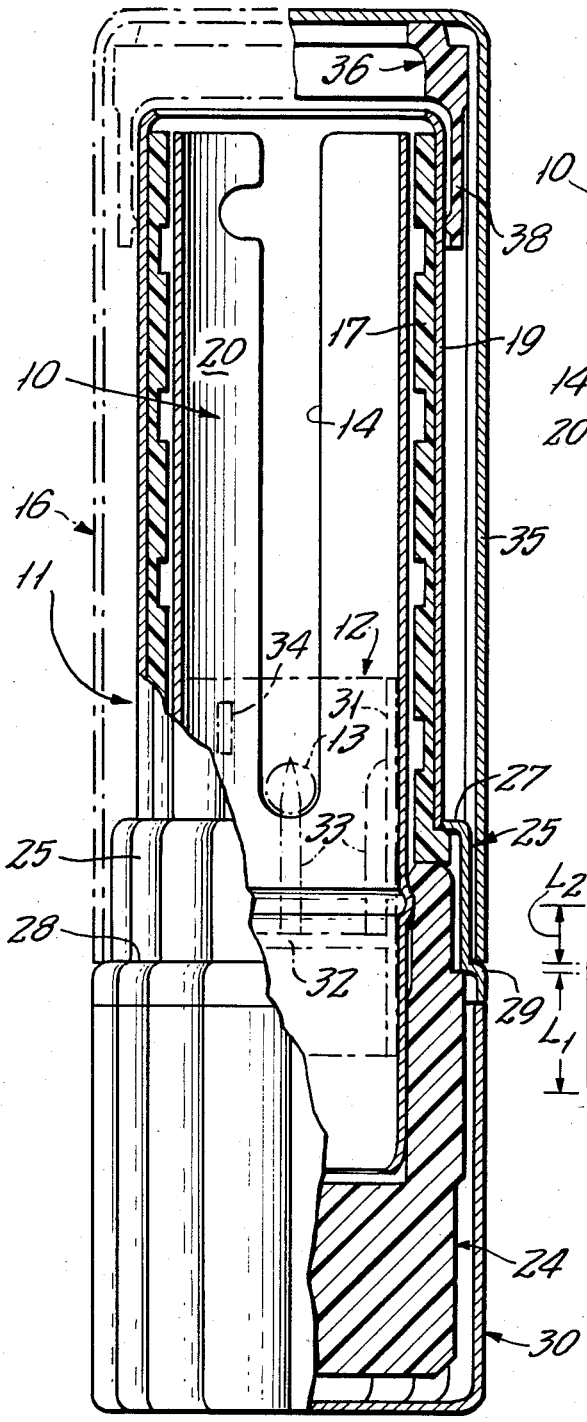
FIG. 1 is an enlarged view in elevation of a container of the invention, partly broken-away and in longitudinal section to reveal internal relationships.
Figure 2:
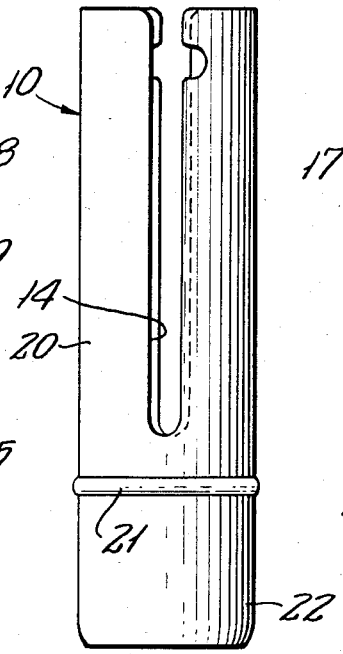
FIGS. 2 and 3 are views in elevation for inner and outer tubular member parts of the container of FIG. 1, the view of FIG. 3 being partly broken-away and in longitudinal section.

Referring initially to FIG. 1, a container of the invention is seen to comprise relatively rotatable inner and outer tubular members 10–11, and a carrier member 12 is guided within inner tubular member 10 for selective elevation of pomade (not shown) with respect to the open upper end of members 10–11. Propulsion of carrier member 12 relies upon cam-follower means 13 on the carrier member, extending radially for concurrent engagement with a straight cam slot 14 in inner tubular member 10 and a spiral cam groove 15 in outer tubular member 11. In the preferred arrangement, follower 13 is in duplicate, projecting in diametrically opposite outward directions, and the straight and spiral cams 14–15 are also in duplicate, concurrently engaging the respective followers at locations 180-degrees apart, with respect to the central longitudinal axis of the container. A removable closure cap 16 is friction-retained to the outer tubular member 11, with anti-rotational keyed engagement to the inner tubular member 10, as will be later explained.

Figure 3:
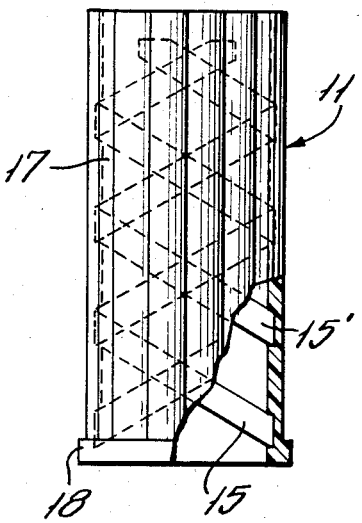
Figure 4:
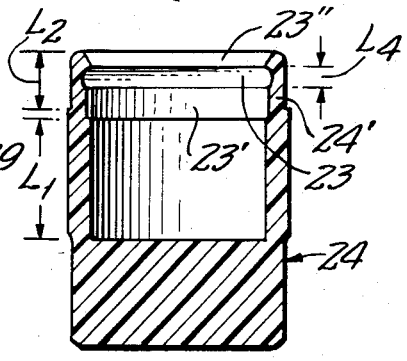
FIG. 4 is a longitudinal section of an adaptor member, being another of the parts of the container of FIG. 1.
Figure 5:
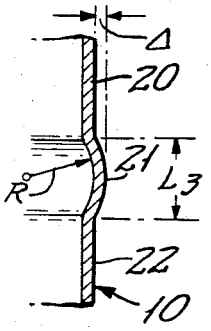
FIG. 5 is an enlarged fragmentary longitudinal section of a bead region of the inner tubular member.

In accordance with a feature of the invention, a predetermined low-level of smooth, circumferentially continuous torsional friction characterizes the relative rotation of members 10–11, and their axial retention is free of axial play. To this end the outer tubular member comprises a sleeve 17 of suitable plastic, which may be injection-molded of medium impact styrene, exhibiting low friction and negligible shrinkage. As best seen in FIG. 3, sleeve 17 is basically straight-cylindrical, with its bore characterized by two spiral cam grooves 15—15' at 180° phase offset. These grooves terminate short of the upper end of sleeve 17 and they are open at the lower end, for assembly acceptance of the two cam followers via the lower end of the sleeve. A radially outward cylindrical flange 18 is an integral formation with the lower end of sleeve 17. The outer surface of sleeve 17 may be cylindrical, but will be understood in the form shown to be characterized by plural longitudinal flutings adapted for permanent press-fitted assembly to corresponding flutings of an outer decorative metal shell 19, to accord with a customer's taste as to external appearance.

Figure 6:
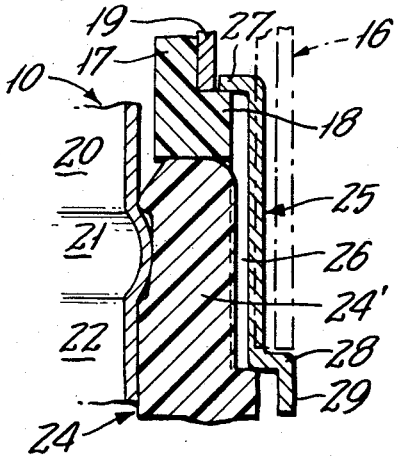
FIG. 6 is an enlarged fragmentary longitudinal section of a force-fitted relation of parts in FIG. 1.

The inner tubular member 10 comprises a formed metal tube having an elongate upper cylindrical propulsion-cam portion 20 having running clearance with the bore of sleeve 17. A radially outward shallow bead 21 integrally connects a cylindrical base portion 22 to the upper portion 20 and defines an axial location for the undercut groove 23 in the skirt of a cup-shaped adaptor member 24, which is assembled over the base portion 22; as best seen in FIGS. 1 and 6, the upper end of adaptor member 24 provides a flange-like annulus of circumferentially continuous shoulder support for the flanged lower end of the plastic sleeve 17. More specifically, the primary bore of adaptor 24 is of length $L_1$ and bore diameter for stabilizing telescopic fit to a major fraction of the cylindrical base portion 22, and beyond this fitted region, the skirt end 24' is of reduced section thickness, wherein a counterbore is characterized by the groove 23, by a short cylindrical portion 23' beneath groove 23, and by an outwardly flared chamfer 23'' above groove 23. In a further characterizing of the skirt end 24', the outer diameter is reduced and cylindrical to a downward extent $L_2$.

The outer diameter of skirt end 24' is in excess of the outer diameter of sleeve flange 18, so that a metal retaining collar 25 may have press-fitted assembly to the base portion 22 by squeezing compression of the skirt end 24', whereby collar 25 and adaptor 24 become permanent parts of inner tubular member 10, without radial interference with flange 18. Collar 25 is an externally exposed part of the container (when cap 16 is removed), and it therefore is shown with decorative flutings, consistent with and complementing the appearance feature noted for the shell 19 around plastic sleeve 17. The flutings in collar 25 will be seen to define radially inward longitudinal ribs 26 in the bore of the collar, and it is via these inward ribs that the press-fit is effected to skirt end 24' and to base portion 22. Collar 25 is further characterized by a radially inward flange 27 at its upper end and by a radially outward flange 28 and short axial skirt 29 at its lower end. The outward flange 28 provides a limiting stop for placement of closure cap 16.

It will be seen that the radially inward collar flange 27 may be the means for not only axially retaining sleeve 17 via its flange 18, but also for applying a circumferentially continuous and uniform predetermined level of light axial squeezing preload of the collar flange 27 and of the skirt end 24' against the sleeve flange 18. By reason of metal-to-plastic preloading engagement of the relatively rotatable elements, in the context of low-friction properties of the involved plastic material, the smoothness of rotational action is in complete contrast to the action of prior constructions, and the engagements are effectively self-lubricating.

The lower base portion of adaptor member 24 is slightly reduced and is chamfered at its lower end to accept force-fitted assembly of a metal base cap 30 to the region of telescoped reception of cylindrical base portion 22, whereby the lower end of the container is permanently closed, and the stabilizing engagement of adaptor 24 to the base end 22 is enhanced by the squeeze generated upon force-fitted assembly of cap 30 thereto. Again, since cap 30 is an externally exposed part, it is shown with longitudinal flutings, consistent with those of shell and collar parts 19–25, and the inwardly directed longitudinal ridges associated with flutings of base cap 30 are the means of permanent press-fit assembly of cap 30 and adaptor 24 to and over base portion 22. The latter press-fit is to the point of axial abutment with the skirt 29 of collar 25, where angular registration and alignment of the flutings of collar 25 and of base cap 30 can be permanent by reason of their respective force-fits to integrally related portions 20-21-22 of inner tubular member 10, via squeeze action or adaptor member 24.

The carrier member 12 is described in detail in said copending application but will be seen from phantom outline in FIG. 1 to be a single piece of injection-molded plastic, for example, of Delrin. Essentially, carrier 12 comprises an elongate thin cylindrical shell 31, with a pomade platform 32 near its lower end, and with its two cam followers 13 midway between platform 32 and the upper end of the carrier. Inwardly directed longitudinal ribs 33 stabilize and correctly retain loaded pomade, and two of these ribs register with the cam followers and therefore contribute to their fidelity of reaction to cam-actuation. The nature of the thin cylindrical shell of the carrier permits of gently compliant local deformation, as angularly spaced outward rib formations 34 of this shell have slight interference with the bore of the cam region 20 of inner tubular member 10; these outward ribs (not completely shown) are in angular interlace with the locations of inward ribs 33.

Figure 7:
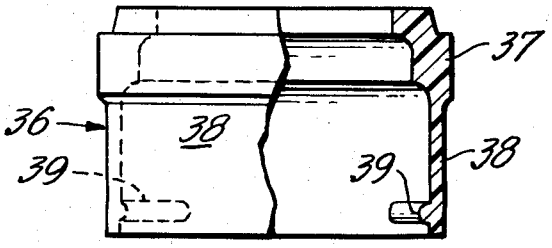
FIG. 7 is a partly broken-away view in elevation of a part of the closure cap of the FIG. 1 container.

The remaining part having external exposure is the closure cap 16, which is shown to comprise a formed metal shell 35 characterized by longitudinal flutings to match and complement external flutings already described. The flutings of shell 35 thus have axially slidable keyed engageability at fit to the flutings of collar 25 (being axially limited at shoulder 28, as shown in FIG. 6); and for frictional retention of the closure cap on the container, preference is indicated for the use of a special insert 36 (FIG. 7) which may be a single injection-molded part, as of medium-density polyethylene. Insert 36 comprises a generally cylindrical annulus 37 sized for interfering press-fit assembly in the bore and to the closed end of shell 35. It is further characterized by an integrally connected lower cylindrical skirt 38, the outer surface of which is relieved from the force-fit engagement, and the inner surface of which is characterized by radially inward circumferentially arcuate ribs 39 at equal angular spacings. Ribs 39 are preferably 60 degrees wide and are thus each able to span the crests of plural adjacent flutings of the upper end of the shell 19 of outer tubular member 11. In unstressed conditions, the radially inner edges of ribs 39 are on a circle having slight interference with the circle of crests of the flutings of shell 19, so that upon placement of the closure cap 16 to the position shown in FIG. 1, the skirt portion 38 of insert 36 becomes compliantly distorted from a pure cylinder, with resilient loading of a friction engagement to the flutings of shell 19.

The described container lends itself to automated assembly, wherein the shallow nature of bead 21 and the chamfer 23'' of adaptor 24 facilitate initial snap-in retention of the engagement to base end 22 and bead 21. Shallowness of bead 21 may be stated in terms of an axial extent $L_3$ which is the chord of an arc (of radius R) of revolution about the central axis of inner tubular member 10, and the radius R of bead arch is preferably such that the total rise or radial offset $\Delta$ occasioned by bead 21 is about one fifth of the axial extent $L_3$. The groove 23 may be of like shallow radial extent but of slightly greater axial length $L_4$, whereby inward deformation of skirt end 24' upon force-fitted assembly to collar 25 can be accommodated in both axial directions away from the crest of bead 21, without impairing the precision of axial position of the upper end of adapter 24, for locating abutment with flange 18 of the outer tubular member.

It should be noted that adaptor 24 serves another function, i.e., beyond facilitating the force-fits of collar 25 and base cap 30. Adaptor 24 lends itself to relatively massive construction, preferably as an injection-molded part, as of A.B.S. material, wherein an axially extensive solid closed lower end provides a deadweight to the entire container, whereby the user can always sense a balanced feel through a center of gravity which is always predominantly toward the closed end of the container.

The described construction will be seen to meet all stated objects, providing a quality "feel" through use of metal-to-plastic engagements wherever relative motion is involved; the only exception to this is that the cam followers are of plastic and engage the spiral cam grooves 15—15' of the sleeve 17 of the outer tubular member. Interference fits characterize the assembly of parts, there being a permanent force-fit for any parts not involved in relative motion. Placement of the closure cap 16 locks the same, in the illustrative case via key-engaged flutings, to the inner tubular member, thus exposing no access to the outer tubular member 11 as long as the cap 16 is in place. Furthermore, the frictional engagement between cap insert 36 and the inner tubular member (at shell 19) provides assurance against vibrational displacement of a loaded carrier in a closed container, in the course of shipping and handling. The described torsional drag attributable to a controlled axial squeeze of plastic flange 18 between two radial-plane formations (21–27) will be seen as an advantage to the user, particularly as the cosmetic substance becomes more consumed, in that retraction of pomade back into the container need not be retraction to the bottom of the actuating cams, and the described keying (to the inner tubular member 10) and rotational braking (to the outer tubular member 11) will be seen to be effective whatever the carrier position when pomade is deemed to be adequately retracted.

While the invention has been described in detail for a preferred form, it will be understood that modifications may be made without departing from the scope of the invention. For example, the flutings referred to herein are but the particular external decoration applied to internal mechanism of somewhat universal application to a wide variety of aesthetic appearances, the basic internal structure common to such a variety being the plastic carrier member 12, the elongate formed tube 20-21-22 (and adaptor 24) of inner tubular member 10, the plastic sleeve 17 of the outer tubular member 11, and the plastic insert 36 for the closure cap. The outer decorative parts, namely collar 25, base cap 30, sleeve shell 19, and closure shell 35 are the only parts that need to be designed for fit to the inner components, in order to create the appearance of a totally new cosmetic container design.

What is claimed is:

1. In a swivel lipstick or the like container wherein a central carrier member has a cam follower engaged to propulsion cams of inner and outer tubular members which are relatively rotatable to develop propel/repel displacement of the carrier member, the improvement wherein the inner tubular member is of metal and has a radially outward circumferential formation between an elongate upper propulsion-cam portion and a lower cylindrical base portion, wherein a molded-plastic adaptor member includes a deformable cylindrical skirt in axially overlapped permanent assembly to said circumferential formation to thereby define a plastic base shoulder of said inner tubular member, wherein the outer tubular member includes a sleeve of molded plastic with an elongate bore having a cam formation in running clearance with the upper portion of said inner tubular member, and wherein the outer tubular member integrally includes a radially outward flange having a lower surface in thrust-bearing engagement with said base shoulder, and a cylindrical metal collar having a bore in force-fitted radially squeezing assembly to the outer surface of said cylindrical skirt and thus also to the inner tubular member, said collar including at its upper end a radially inward flange in axially locating relation with the upper surface of the flange of said outer tubular member.

2. The improvement of claim 1, in which the cam formation of said inner tubular member is a straight slot the upper end of which is fully open to at least the width of said cam follower, said slot terminating at least no lower than the upper surface of said shoulder formation; and in which the cam formation in the bore of said sleeve is a spiral which terminates short of the upper axial end of the sleeve and is fully open at the lower axial end of the sleeve.

3. The improvement of claim 1, in which the plastic of said sleeve is of relatively low friction coefficient, and in which the force-fit of said collar axially loads said collar flange and said shoulder to a predetermined extent of compressional engagement to said sleeve flange, thereby eliminating axial play between said tubular members and producing a controlled degree of torsional resistance to relative rotation of said tubular members.

4. The improvement of claim 1, in which the circumferential formation of said inner tubular member is a convex bead, and in which the bore of said adaptor member has a concave groove in lapped interference fit to said bead.

5. The improvement of claim 4, in which said shoulder is the upper one of two axially spaced radial shoulder formations of said adaptor member on opposite axial sides of said groove, said collar being force-fitted to the region between said shoulder formations and in overlap with both axial sides of said groove.

6. The improvement of claim 5, in which said adaptor member further integrally includes a second lower cylindrical portion depending below the lower one of said shoulder formations, and a base-closure cup having a bore in force-fitted assembly to the outer surface of said second lower cylindrical portion and in axial overlap with at least a portion of the lower cylindrical base portion of the inner tubular member.

7. The improvement of claim 6, in which the upper end of said base-closure cup abuts the lower end of said collar.

8. The improvement of claim 6, in which said cup is of metal.

9. The improvement of claim 1, in which said outer tubular member further includes an outer tubular metal shell in permanently assembled force-fit relation to said sleeve.

10. The improvement of claim 1, in which the lower end of said collar is integrally formed with a radially outward shoulder, and a cupped elongate closure cap of length to fit over the upper end of said tubular members and to abut the lower-end shoulder of said collar, said cap having internal radially yieldable detent means having friction engagement with the outer surface of the upper end of said outer tubular member when in lower-end shoulder abutment with said collar.

11. The improvement of claim 10, in which said closure cap is a metal cup with a plastic insert permanently fitted to the bore of the cup and at the closed end thereof, said detent means being an integral formation of said inert.

12. The improvement of claim 1, in which said carrier member comprises a compliant cylindrical outer shell integrally including said cam follower at an axially intermediate location, a pomade-locating platform within said shell and axially beneath said cam follower, and angularly spaced stabilizing ribs at angular locations offset from the angular location of said cam follower and integrally formed in the outer surface of said shell at a location axially above said cam follower, said ribs projecting radially from said shell and having light running interference with the bore diameter of said inner tubular member.

13. The improvement of claim 1, in which said cam follower is one of two projecting outwardly in diametrically opposite directions, and in which each of said tubular members has two like cam formations at 180° angular offset from each other for concurrent engagement with said cam followers.

14. The improvement of claim 10, in which said collar has external axially extending fluting formations between its radially outward shoulder and its radially inward flange, and in which said cap integrally includes inward flutings having anti-rotational engagement with collar flutings when in lower-end shoulder abutment with said collar.

15. The improvement of claim 1, in which said carrier member is of molded plastic.

16. In a swivel lipstick or the like container wherein a central carrier member has a cam follower engaged to propulsion cams of inner and outer tubular members which are relatively rotatable to develop propel/repel displacement of the carrier member, the improvement wherein the inner tubular member is of metal and has a radially outward circumferential formation between an elongate upper propulsion-cam portion and a lower cylindrical base portion, wherein the outer tubular member has (1) an elongate bore having a cam formation in running clearance with the upper portion of said inner tubular member, and (2) a radially outward flange at its lower end, wherein a cylindrical metal collar includes a radially inward flange in thrust-bearing relation with said radially outward flange and is in permanently assembled force-fitted relation to said inner tubular member at and axially below said circumferential formation, the lower end of said collar being integrally formed with a radially outward shoulder, and a cupped elongate closure cap of length to fit over the upper end of said tubular members and to abut the lower-end shoulder of said collar, said cap having internal radially yieldable detent means having friction engagement with the outer surface of the upper end of said outer tubular member when in lower-end shoulder abutment with said collar.

17. The improvment of claim 16, in which a cylindrical adaptor formation of stiffly yieldable molded plastic is compressionally interposed between said collar and inner tubular member and is the means of establishing the force-fitted relation.

18. The improvement of claim 17, in which said cylindrical adaptor formation is integrally formed with a relatively massive solid base-end closure, whereby to develop a more axially downward axial-location of the center of gravity of the container.

* * * * *